US009477173B2

(12) United States Patent
Watanabe

(10) Patent No.: US 9,477,173 B2
(45) Date of Patent: Oct. 25, 2016

(54) DEVELOPING DEVICE AND IMAGE FORMING APPARATUS

(71) Applicant: KYOCERA Document Solutions Inc., Osaka-shi, Osaka (JP)

(72) Inventor: Akihiro Watanabe, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 15/002,306

(22) Filed: Jan. 20, 2016

(65) Prior Publication Data

US 2016/0209775 A1 Jul. 21, 2016

(30) Foreign Application Priority Data

Jan. 21, 2015 (JP) ..... 2015-009729

(51) Int. Cl.
*G03G 15/00* (2006.01)
*G03G 15/08* (2006.01)

(52) U.S. Cl.
CPC ..... *G03G 15/0812* (2013.01); *G03G 15/0865* (2013.01)

(58) Field of Classification Search
CPC ..... G03G 15/0812; G03G 15/0865; G03G 21/1676
USPC ..... 399/119, 273, 274
See application file for complete search history.

(56) References Cited

U.S. PATENT DOCUMENTS

2005/0025506 A1* 2/2005 Adachi ..... G03G 21/1889 399/27
2007/0297834 A1* 12/2007 Nishida ..... G03G 15/0812 399/284
2013/0108330 A1* 5/2013 Kitagawa ..... G03G 15/0194 399/284

FOREIGN PATENT DOCUMENTS

JP 2009258276 A 11/2009

* cited by examiner

*Primary Examiner* — Walter L Lindsay, Jr.
*Assistant Examiner* — Jessica L Eley
(74) *Attorney, Agent, or Firm* — Alleman Hall McCoy Russell & Tuttle LLP

(57) ABSTRACT

A developing device includes a developer carrying body, a layer thickness limiting portion, and a rotation control portion. The layer thickness limiting portion includes a base body and a flexible member. The base body protrudes toward a part at a third position between a first position and a second position on the outer circumferential surface of the developer carrying body. The flexible member is a sheet-like member having flexibility, and is attached to the base body such that the flexible member covers, via a gap, a range of the base body from a front end surface facing the developer carrying body to an upper surface, and a bent portion covering a boundary portion between the front end surface and the upper surface of the base body is closer to the outer circumferential surface of the developer carrying body than the other part is.

12 Claims, 8 Drawing Sheets

DEVELOPING DEVICE AND IMAGE FORMING APPARATUS

INCORPORATION BY REFERENCE

This application is based upon and claims the benefit of priority from the corresponding Japanese Patent Application No. 2015-009729 filed on Jan. 21, 2015, the entire contents of which are incorporated herein by reference.

BACKGROUND

The present disclosure relates to a developing device which develops an electrostatic latent image by electrophotography, and an image forming apparatus including the developing device.

Generally, in a developing device provided in an image forming apparatus such as a multifunction peripheral, for example, the layer thickness of developer formed on the surface of a developer carrying body is limited by a layer thickness limiting member. At this time, scattered toner is accumulated on the surface of the layer thickness limiting member. When the accumulated toner increases, the accumulated toner transfers from the layer thickness limiting member to a photosensitive body, whereby the image quality might be adversely affected.

In an image forming apparatus using a two-component developer, carrier contained in the two-component developer forms a magnetic brush on the surface of the developer carrying body. In the image forming apparatus, it is known that the developer carrying body is rotated in a direction opposite to a rotation direction in a developing process, to scrape the accumulated toner by the magnetic brush.

SUMMARY

A developing device according to one aspect of the present disclosure includes a developer carrying body, a layer thickness limiting portion, and a rotation control portion. The developer carrying body is configured to, in a developer container, rotate in a first rotation direction while carrying a two-component developer on an outer circumferential surface of the developer carrying body, thereby conveying the two-component developer from a lower first position to an upper second position and feeding, at the second position, toner contained in the two-component developer to a toner carrying body at a next stage. The layer thickness limiting portion is provided, via a gap, being opposed to a part at a third position between the first position and the second position on the outer circumferential surface of the developer carrying body, and is configured to limit a layer thickness of the two-component developer carried by the developer carrying body rotating in the first rotation direction. The rotation control portion is configured to rotate the developer carrying body in the first rotation direction when a development process is performed, and rotate the developer carrying body in a second rotation direction opposite to the first rotation direction when the development process is not performed. The layer thickness limiting portion includes a base body and a flexible member. The base body protrudes toward a part at the third position on the outer circumferential surface of the developer carrying body. The flexible member is a sheet-like member having flexibility, and is attached to the base body such that the flexible member covers, via a gap, a range of the base body from a front end surface facing the developer carrying body to an upper surface, and a bent portion covering a boundary portion between the front end surface and the upper surface of the base body is closer to the outer circumferential surface of the developer carrying body than another part is.

An image forming apparatus according to another aspect of the present disclosure includes: a photosensitive body that allows an electrostatic latent image to be formed on a surface thereof, the developing device configured to feed the toner to the photosensitive body, thereby developing the electrostatic latent image into a toner image; and a transfer portion configured to transfer the toner image formed on the photosensitive body, to a recording sheet.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described with reference to the accompanying drawings. The following embodiments are examples in which the present disclosure is embodied, and are not intended to limit the technical scope of the present disclosure.

Figure 1:
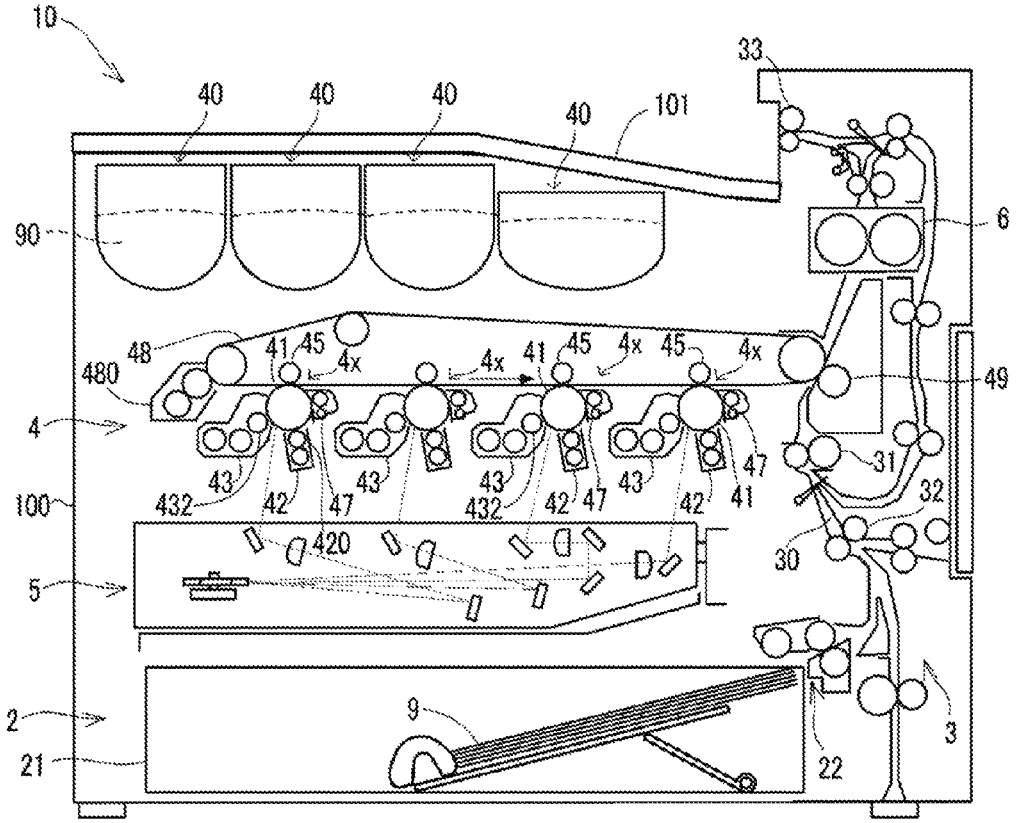
FIG. 1 is a configuration diagram of an image forming apparatus according to a first embodiment of the present disclosure.

First, with reference to FIGS. 1 and 2, the configuration of an image forming apparatus 10 according to a first embodiment of the present disclosure will be described. The image forming apparatus 10 is an image forming apparatus of an electrophotography type. As shown in FIG. 1, the image forming apparatus 10 includes, in a housing 100, a sheet feed portion 2, a sheet conveyance portion 3, a toner supply portion 40, an image forming portion 4, a laser scanning portion 5, a fixing portion 6, and the like.

The image forming apparatus 10 shown in FIG. 1 is a tandem-type image forming apparatus, and is a color printer. Therefore, the image forming portion 4 further includes an intermediate transfer belt 48, a secondary cleaning device 480, and a secondary transfer device 49.

In addition, the image forming portion 4 includes a plurality of single-color image forming portions 4*x* respectively corresponding to cyan, magenta, yellow, and black. Further, the image forming apparatus 10 includes a plurality of the toner supply portions 40 which feed toners for cyan, magenta, yellow, and black to developer tanks 450 (see FIG. 2) of the developing devices 43 described later. The toner supply portions 40 are detachably attached at predetermined positions in the image forming apparatus 10. In the present embodiment, the toner supply portions 40 are attached above the image forming portion 4. The toner supply portions 40 correspond to a toner feed portion.

The image forming apparatus 10 is, for example, a printer, a copy machine, a facsimile, a multifunction peripheral, or the like. The multifunction peripheral has the function of a printer, the function of a copy machine, and the like at the same time.

The sheet feed portion 2 includes a sheet reception portion 21 and a sheet sending portion 22. The sheet reception portion 21 is configured to allow a plurality of recording sheets 9 to be stacked thereon. The recording sheet 9 is a sheet-like image formation medium such as paper, coated paper, a postcard, an envelope, an OHP sheet, or the like.

The sheet sending portion 22 sends the recording sheet 9 from the sheet reception portion 21 to a conveyance path 30 by rotating in contact with the recording sheet 9.

The sheet conveyance portion 3 includes a registration roller 31, a conveyance roller 32, a discharge roller 33, and the like. The registration roller 31 and the conveyance roller 32 convey the recording sheet 9 fed from the sheet feed portion 2, to the secondary transfer device 49 of the image forming portion 4. Further, the discharge roller 33 discharges the recording sheet 9 on which an image has been formed, onto a discharge tray 101 through a discharge port of the conveyance path 30.

The intermediate transfer belt 48 is an endless belt-like member formed in a loop shape. The intermediate transfer belt 48 circulates being stretched between two rollers. In the image forming portion 4, each single-color image forming portion 4*x* forms an image for the corresponding color on the surface of the circulating intermediate transfer belt 48. Thus, a color image composed of overlaid images for the respective colors is formed on the intermediate transfer belt 48.

The secondary transfer device 49 transfers a toner image formed on the intermediate transfer belt 48 to the recording sheet 9. The secondary cleaning device 480 removes the remaining toner on a part, of the intermediate transfer belt 48, that has passed through the secondary transfer device 49.

Each single-color image forming portion 4*x* includes a photosensitive drum 41 which carries a toner image, a charging device 42, a developing device 43, a primary transfer device 45, a primary cleaning device 47, and the like. The photosensitive drum 41 is an example of a photosensitive body which carries a toner image while rotating. The primary transfer device 45, the intermediate transfer belt 48, and the secondary transfer device 49 correspond to a transfer portion which transfers the toner image formed on the photosensitive drum 41 to the recording sheet 9.

Each photosensitive drum 41 rotates at a peripheral velocity according to the peripheral velocity (movement velocity) of the intermediate transfer belt 48. For example, the photosensitive drum 41 may be an organic photosensitive body. Alternatively, the photosensitive drum 41 may be an amorphous silicon photosensitive body.

In each single-color image forming portion 4*x*, the photosensitive drum 41 rotates, and the charging device 42 charges the surface of the photosensitive drum 41 uniformly. Further, the laser scanning portion 5 scans a laser beam to draw an electrostatic latent image on the charged surface of the photosensitive drum 41.

The developing device 43 feeds toner to the photosensitive drum 41, thereby developing the electrostatic latent image. The developing device 43 in the present embodiment agitates a two-component developer 90 containing toner and carrier, thereby charging the toner, and feeds the charged toner to the photosensitive drum 41.

The charging device 42 includes a charging roller 420 which charges a part, of the photosensitive drum 41, on which an electrostatic latent image has not been drawn yet.

Figure 2:
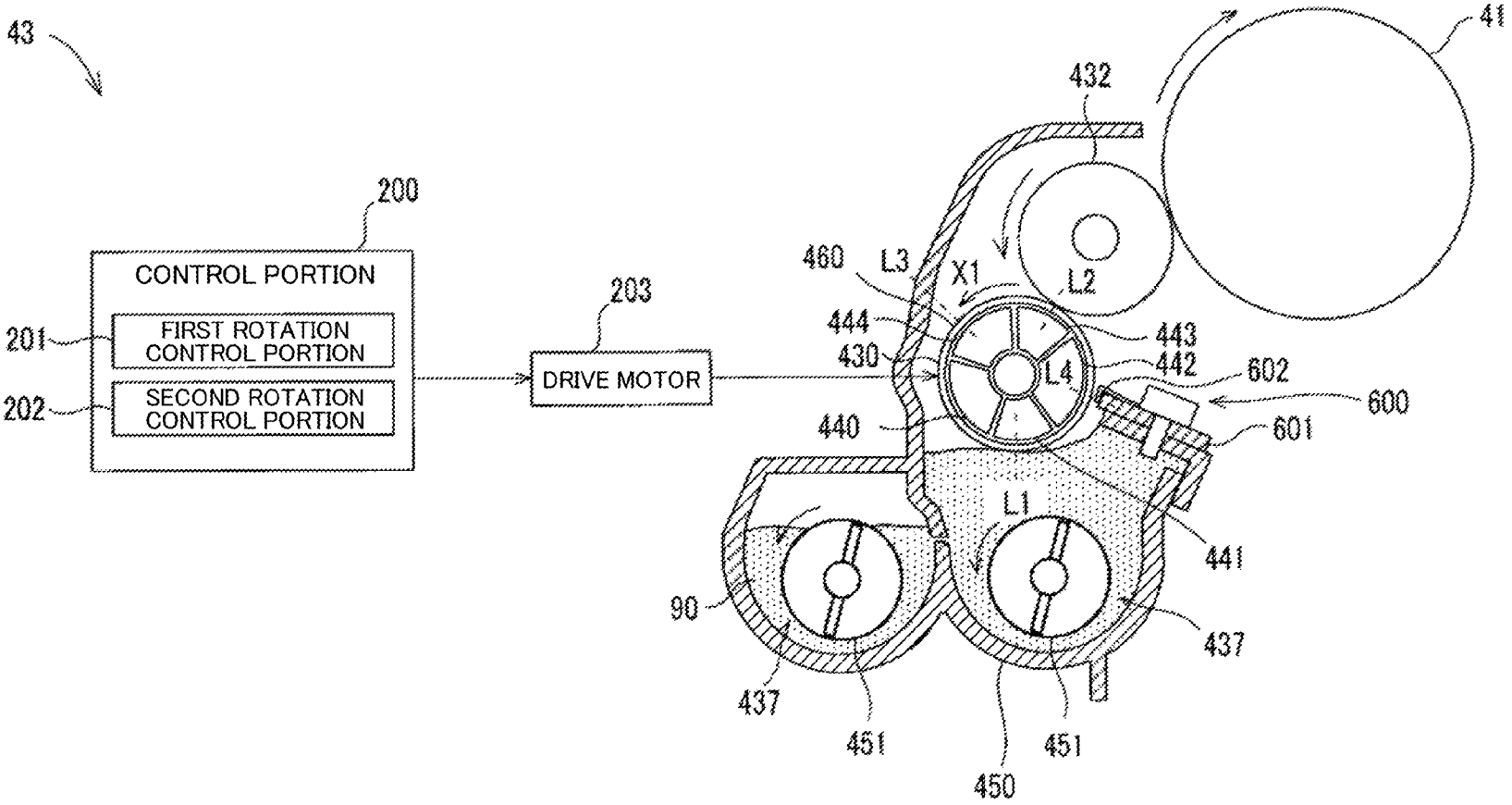
FIG. 2 is a configuration diagram of a photosensitive drum and a developing device in an image forming portion of the image forming apparatus according to the first embodiment of the present disclosure.

As shown in FIG. 2, the developing device 43 includes the developer tank 450, a magnetic roller 430, a developing roller 432, an agitation mechanism 437, and a layer thickness limiting portion 600. The magnetic roller 430, the developing roller 432, and the agitation mechanism 437 are rotatably supported around respective rotation shafts that are parallel with each other.

Figure 5A:
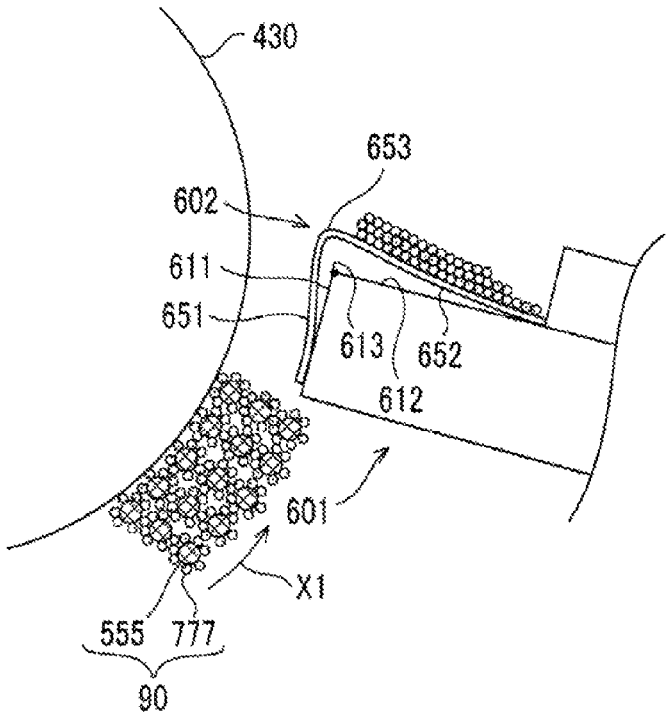
FIG. 5A and FIG. 5B are diagrams showing the state of a flexible member and the state of a two-component developer carried by a magnetic roller when the magnetic roller is forward rotated.
Figure 5B:
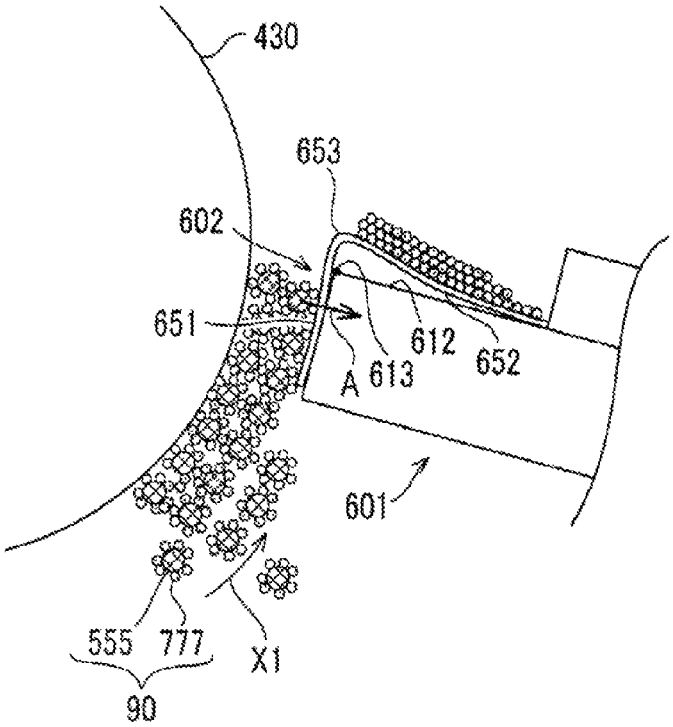

The developer tank 450 accommodates a two-component developer that contains toner 777 (see FIG. 5A and FIG. 5B) and carrier 555 (see FIG. 5A and FIG. 5B). As the toner 777, toner is fed from the toner supply portion 40 (see FIG. 1). The toner 777 is a particle mainly composed of resin, and the carrier 555 is a particle containing a magnetic material. The particle diameter of the toner 777 is smaller than the particle diameter of the carrier 555. The weight of the toner 777 is smaller than the weight of the carrier 555. The magnetic material of the carrier 555 is, for example, ferrite or the like. As described later, the toner 777 is charged with static electricity caused due to friction against the carrier 555 by being mixed and agitated with the carrier 555. Owing to the presence of the carrier 555, the two-component developer 90 allows the toner 777 to be charged more easily than a one-component developer containing only toner, and therefore contributes to increase in the image quality.

The agitation mechanism 437 is rotatably provided inside the developer tank 450. The agitation mechanism 437 agitates the two-component developer 90 in the developer tank 450.

The agitation mechanism 437 includes a screw member 451.

The screw member 451 is a long member elongated along a direction perpendicular to the drawing plane of FIG. 2. The screw member 451 is made from resin. The screw member 451 is rotatably supported by side walls (not shown), of the developer tank 450, that are present at both ends in a direction perpendicular to the drawing plane of FIG. 2.

By the screw member 451 rotating, the two-component developer 90 in the developer tank 450 moves. Thus, the two-component developer 90 in the developer tank 450 is agitated. By the agitation, the toner 777 and the carrier 555 are rubbed with each other. Static electricity caused by their friction charges the toner 777 at a predetermined polarity. The carrier 555 is charged at a polarity opposite to the charge polarity of the toner 777. By the electrostatic force, the toner 777 is adhered to the carrier 555.

The magnetic roller 430 is rotatably provided inside the developer tank 450. The magnetic roller 430 attracts, by a magnetic force, the two-component developer 90 agitated by the agitation mechanism 437, and carries the two-component developer 90 on the surface of the magnetic roller 430.

The magnetic roller 430 has a sleeve portion 460 and a magnet 440.

The sleeve portion 460 has a cylindrical shape, and encloses the magnet 440. The sleeve portion 460 is formed by a nonmagnetic member. The sleeve portion 460 can rotate forward and reversely. In a development process, the sleeve portion 460 rotates in one direction. In the following description, the rotation direction of the sleeve portion 460 in the development process is referred to as a development rotation direction X1. The development rotation direction X1 corresponds to a first rotation direction. In the present embodiment, the development rotation direction X1 is the counterclockwise direction in FIG. 2.

A plurality of the magnets 440 are provided inside the sleeve portion 460. The plurality of magnets 440 are arranged via predetermined intervals therebetween along the circumferential direction. The positions of the magnets 440 are fixed inside the sleeve portion 460. The plurality of magnets 440 include a magnet 441, a magnet 442, a magnet 443, and a magnet 444.

The magnet 441 is provided at a position that faces the two-component developer 90 in the developer tank 450. The magnet 441 attracts the two-component developer 90 contained in the developer tank 450. Thus, the two-component developer 90 is adhered to a part, of the surface of the sleeve portion 460 of the magnetic roller 430, that is at the magnet 441. A position L1 in FIG. 2 indicates a developer transfer position L1 at which the two-component developer 90 contained in the developer tank 450 is transferred to the sleeve portion 460. The developer transfer position L1 corresponds to a first position.

The magnet 442 is provided at a position that is on the downstream side relative to the magnet 441 in the development rotation direction X1 and is adjacent to the magnet 441. The magnet 442 causes the sleeve portion 460 to carry the two-component developer 90 thereon.

By magnetic forces of the magnet 441 and the magnet 442, a developer layer is formed on the surface of the sleeve portion 460. On the developer layer, a magnetic brush K1 (see FIG. 6A) is formed. In the present embodiment, the sleeve portion 460 of the magnetic roller 430 is an example of a developer carrying body which carries the two-component developer 90.

The magnetic brush K1 is a plurality of chain bodies formed by a plurality of the carriers which are contained in the two-component developer 90 and which are linked in a chain form from the surface of the magnetic roller 430 by magnetic forces of the magnets 441 and 442.

Biases are applied to the magnetic roller 430 and the developing roller 432, and a predetermined potential difference is provided between the magnetic roller 430 and the developing roller 432. Owing to the potential difference, the toner contained in the two-component developer 90 carried by the magnetic roller 430 is transferred to the developing roller 432. A position L2 in FIG. 2 indicates a toner transfer position L2 at which the toner contained in the two-component developer 90 carried by the magnetic roller 430 is transferred to the developing roller 432. The toner transfer position L2 corresponds to a second position.

Thus, the magnetic roller 430 is rotatably supported in the developer tank 450, and by rotating in the development rotation direction X1, feeds, at the toner transfer position L2, the toner contained in the two-component developer 90 to the developing roller 432 at the next stage while carrying the two-component developer 90 on the surface of the magnetic roller 430.

The magnet 443 is provided at a position that faces the developing roller 432, and attracts, to the sleeve portion 460, the carrier 555 left on the magnetic roller 430 after the toner 777 has been transferred to the developing roller 432 at the toner transfer position L2. The carrier 555 attracted to the sleeve portion 460 by the magnet 443 keeps formation of the magnetic brush K1.

After the toner has been transferred to the developing roller 432 at the toner transfer position L2, the magnet 444 separates the carrier 555 left on the surface of the magnetic roller 430 from the surface by the magnetic force thereof, thereby dropping the carrier 555 to the developer tank 450 below. A position L3 in FIG. 2 indicates a separation position L3 at which the carrier 555 left on the surface of the magnetic roller 430 is separated from the surface by the magnetic force.

In the development process, the magnetic roller 430 receives the two-component developer 90 from the developer tank 450 at the developer transfer position L1 by the magnetic force of the magnet 441, and conveys the two-component developer 90 by rotation of the sleeve portion 460 in the development rotation direction X1. When the two-component developer 90 is conveyed to the toner transfer position L2, the toner contained in the two-component developer 90 is transferred to the developing roller 432 at the next stage by the potential difference between the magnetic roller 430 and the developing roller 432. At this time, the carrier 555 is left on the surface of the magnetic roller 430.

The magnetic roller 430 conveys the carrier 555 to the separation position L3 by further rotation of the sleeve portion 460 in the development rotation direction X1. Then, when the carrier 555 is conveyed to the separation position L3 by the magnetic roller 430, the carrier 555 is separated from the magnetic roller 430 by a repulsive force between the carrier 555 and the magnet 444. Thus, the separated carrier 555 drops to the developer tank 450 below.

The layer thickness limiting portion 600 is provided at a layer thickness limiting position L4 on the upstream side relative to the toner transfer position L2 in the development rotation direction X1 on the outer circumference of the magnetic roller 430. The layer thickness limiting portion 600 limits the thickness of the developer layer moving toward the toner transfer position L2. The layer thickness limiting portion 600 will be described later.

The developing roller 432 receives, from the magnetic roller 430, the toner contained in the two-component developer 90 carried by the magnetic roller 430. On the surface of the developing roller 432, a toner layer is formed by the received toner.

The developing roller 432 is opposed to the photosensitive drum 41 in a contactless manner. By the bias applied to the developing roller 432, the toner on the developing roller 432 is transferred to a part corresponding to the electrostatic latent image formed on the outer circumferential surface of the photosensitive drum 41. That is, the developing roller 432 feeds the toner 777 to the photosensitive drum 41 on the surface of which the electrostatic latent image is formed, thereby developing the electrostatic latent image. The developing roller 432 is an example of a toner carrying body.

In the development process, the developing roller 432 rotates in the same direction as the magnetic roller 430. Thus, the mutually opposed portions of the outer circumferential surfaces of the magnetic roller 430 and the developing roller 432 respectively move in the opposite directions.

In the development process, the developing roller 432 and the photosensitive drum 41 respectively rotate in the opposite directions. Thus, the mutually opposed portions of the outer circumferential surfaces of the developing roller 432 and the photosensitive drum 41 move in the same direction.

Thus, the toner 777 contained in the two-component developer 90 is consumed in the development process. Therefore, the toner 777 is supplied from the toner supply portion 40 to the developer tank 450, to compensate the consumption. Meanwhile, the carrier 555 contained in the two-component developer 90 is hardly consumed but is left in the developer tank 450, and gives fluidity and the like to the toner 777 supplied to the developer tank 450.

The developing device 43 has a drive motor 203. The drive motor 203 rotationally drives the magnetic roller 430. The drive motor 203 may be a DC brushless motor, a stepping motor, or the like.

The developing device 43 has a control portion 200. The control portion 200 includes a CPU (Central Processing Unit), a ROM (Read Only Memory), and a RAM (Random Access Memory).

The CPU is a processor that executes various calculation processes. The ROM is a nonvolatile storage portion in which information such as a control program for causing the CPU to execute the various processes is stored in advance. The RAM is a volatile storage portion used as a temporary storage memory (working area) for the various processes executed by the CPU. The control portion 200 causes the CPU to execute the program stored in the ROM, thereby controlling operation of the image forming apparatus 10.

In the ROM of the control portion 200, a processing program for causing the CPU of the control portion 200 to execute a process described later (see a flowchart in FIG. 4) is stored. The processing program may be stored in the ROM at a stage of shipment of the image forming apparatus 10. Alternatively, the processing program may be stored in a computer-readable non-transitory information storage medium such as a CD (Compact Disc), a DVD (Digital Versatile Disc), or a flash memory, and then after the shipment, the processing program may be stored into the ROM of the control portion 200 from the information storage medium. In another embodiment, a part or a plurality of the functions of the control portion 200 may be provided as an electronic circuit.

The control portion 200 includes a first rotation control portion 201 and a second rotation control portion 202.

In the development process, the first rotation control portion 201 performs forward rotation control to rotate the magnetic roller 430 at a predetermined first rotation velocity V1 in the development rotation direction X1 described above.

In a non-development process, the second rotation control portion 202 performs reverse rotation control to rotate the magnetic roller 430 in a rotation direction (hereinafter, referred to as a reverse rotation direction) X2 opposite to the development rotation direction X1. Here, in the reverse rotation control, the second rotation control portion 202 reversely rotates the magnetic roller 430 at a second rotation velocity V2 equal to or different from the first rotation velocity V1. The reverse rotation direction X2 corresponds to a second rotation direction.

For example, the rotation angle of the magnetic roller 430 in the reverse rotation control may be not smaller than the rotation angle from the separation position L3 to the layer thickness limiting position L4 in the reverse rotation direction X2 but smaller than one revolution.

Also in conventional developing devices, the layer thickness of a two-component developer on a magnetic roller is limited by a layer thickness limiting portion. The conventional layer thickness limiting portion is composed of only a blade-like member made of a hard material. Toner scattered when the layer thickness of the two-component developer on the magnetic roller is limited by the layer thickness limiting portion is accumulated on the surface of the layer thickness limiting portion. When the accumulated toner increases, the increased accumulated toner transfers from the layer thickness limiting portion to the photosensitive drum via a developing roller, and thus may cause adverse influence on the image quality.

Considering the above problem, using the fact that a magnetic brush is formed on the surface of the magnetic roller by carrier contained in the two-component developer, the magnetic roller may be rotated in a reverse rotation direction opposite to the forward rotation direction which is a rotation direction in a development process, whereby the accumulated toner may be scraped by the magnetic brush.

However, in the case of performing control for rotation in the reverse rotation direction, technology for further enhancing the performance for removing the accumulated toner from the surface of the layer thickness limiting portion is required. Accordingly, the following configuration is provided in the present embodiment.

Figure 3:
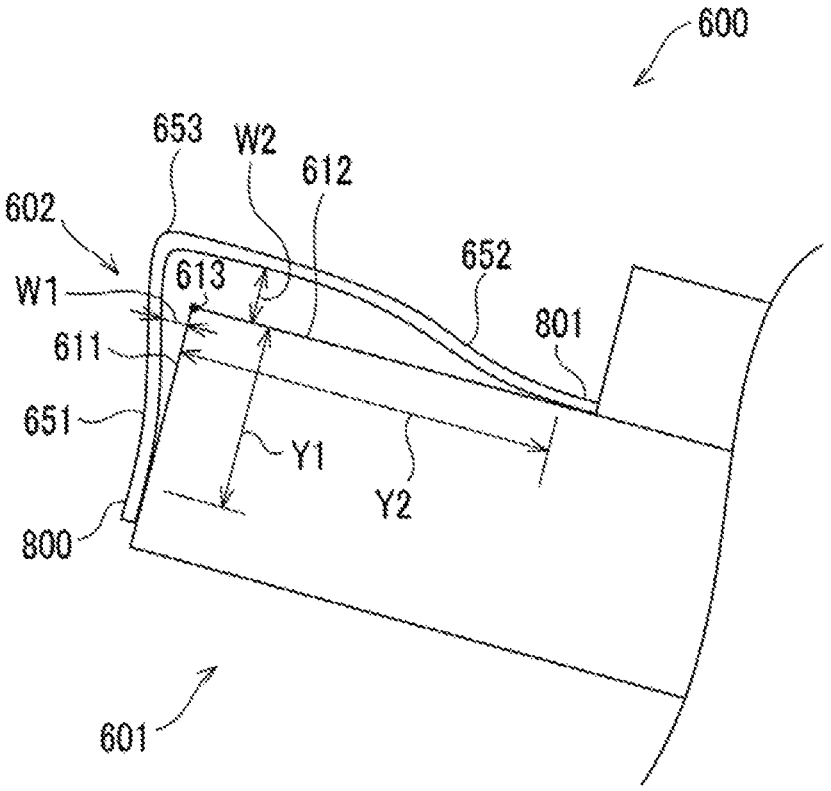
FIG. 3 is a configuration diagram of a layer thickness limiting portion.

As shown in FIG. 3, the layer thickness limiting portion 600 includes a blade 601 and a flexible member 602.

The blade 601 is provided at the layer thickness limiting position L4 via a gap from the surface of the magnetic roller 430, and protrudes toward a part at the layer thickness limiting position L4, of the outer circumferential surface of the magnetic roller 430. Therefore, the blade 601 has a front end surface 611 and an upper surface 612. The blade 601 is a hard-material member and corresponds to a base body. The layer thickness limiting position L4 corresponds to a third position. In the present embodiment, the front end portion of the blade 601 has a rectangular sectional shape.

The blade 601 limits the layer thickness of the two-component developer 90 carried by the magnetic roller 430 that rotates in the development rotation direction X1. In the present embodiment, the separation position L3 and the layer thickness limiting position L4 are substantially opposite to each other with respect to the rotation axis of the magnetic roller 430.

The flexible member 602 is a sheet-like member having flexibility. In the present embodiment, the flexible member 602 is mainly composed of polyethylene terephthalate.

The flexible member 602 covers, via a gap, a range of the blade 601 from the front end surface 611 facing the magnetic roller 430 to the upper surface 612.

Specifically, the flexible member 602 has a first opposed portion 651 and a second opposed portion 652. In the flexible member 602, a boundary part between the first opposed portion 651 and the second opposed portion 652 forms a bent portion 653. The bent portion 653 covers a boundary portion 613 between the front end surface 611 and the upper surface 612, on the blade 601.

The first opposed portion 651 is opposed to the front end surface 611 of the blade 601, via a gap W1. The flexible member 602 is fixed to the front end surface 611 of the blade 601, at an end portion 800 of the first opposed portion 651. The end portion 800 is at a position distant by an interval Y1 from the boundary portion 613 between the front end surface 611 and the upper surface 612 of the blade 601, on the front end surface 611 of the blade 601. The interval Y1 corresponds to a first interval. In the present embodiment, the flexible member 602 is fixed to the front end surface 611 by the end portion 800 being bonded to the front end surface 611 of the blade 601 by an adhesive agent.

The second opposed portion 652 is opposed to the upper surface 612 of the blade 601, via a gap W2. The flexible member 602 is fixed to the upper surface 612 of the blade 601, at an end portion 801 of the second opposed portion 652. The end portion 801 is at a position distant by an interval Y2 from the boundary portion 613, on the upper surface 612 of the blade 601. The interval Y2 corresponds to a second interval. In the present embodiment, the flexible member 602 is fixed to the upper surface 612 by the end portion 801 being bonded by an adhesive agent.

In the present embodiment, the flexible member 602 is attached to the blade 601 such that the bent portion 653 is closer to the outer circumferential surface of the magnetic roller 430 than the other part is.

Figure 4:
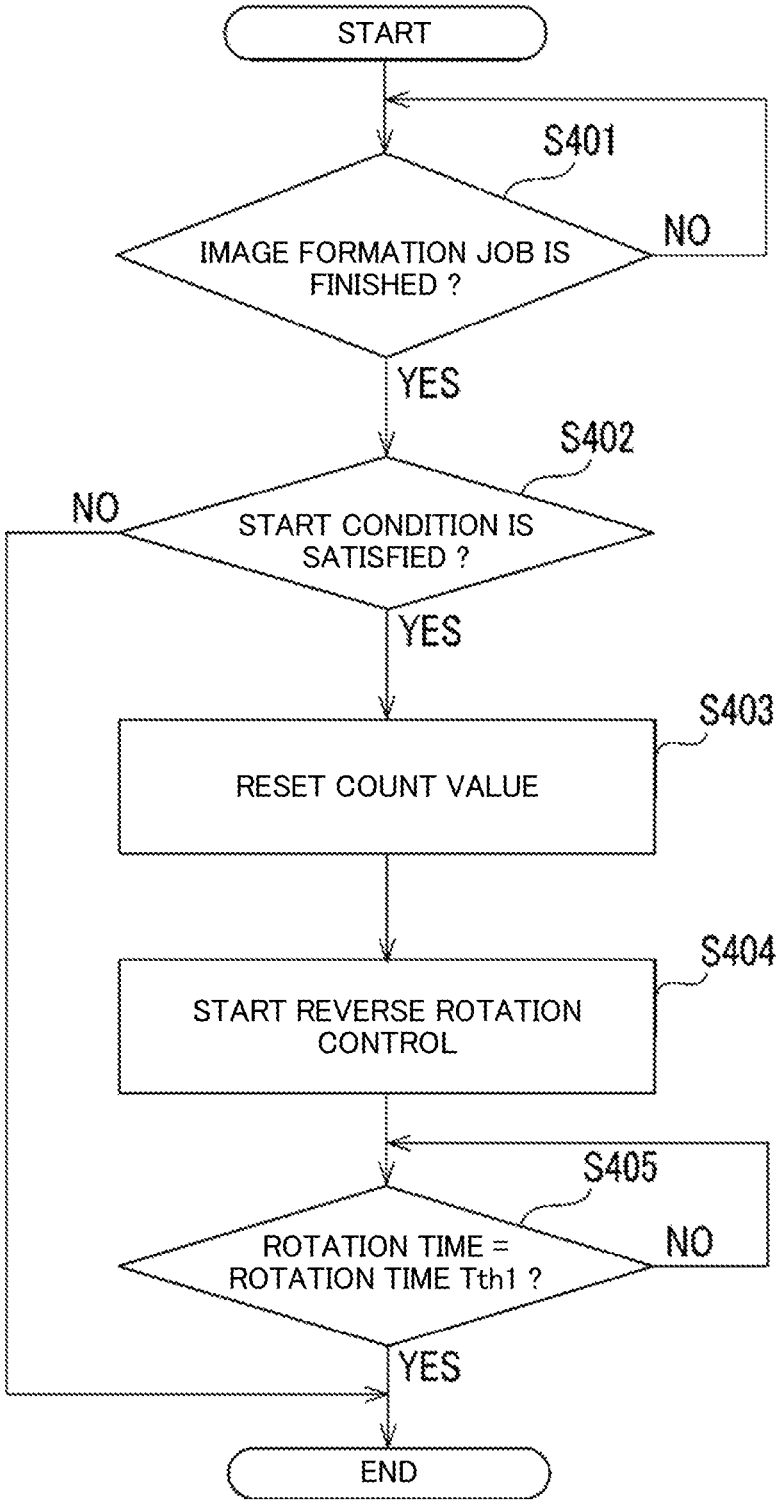
FIG. 4 is a flowchart showing a process by a control portion.

Next, with reference to FIG. 4, a process by the control portion 200 will be described. In the flowchart in FIG. 4, steps S401, S402, . . . indicate the numbers of steps in the processing procedure. The process by the control portion 200 shown in FIG. 4 is started when an image formation job accompanied by the development process is executed.

<Step S401>

In step S401, the control portion 200 determines whether or not the image formation job has been finished. If it is determined that the image formation job has not been finished (NO in step S401), the control portion 200 executes the processing in step S401 again.

During execution of the image formation job, the forward rotation control is performed by the first rotation control portion 201. In the forward rotation control, as shown in FIG. 5A and FIG. 5B, the magnetic roller 430 rotates in the development rotation direction X1, and the layer thickness of the two-component developer 90 carried on the surface of the magnetic roller 430 is limited by the layer thickness limiting portion 600.

At the beginning of the forward rotation control, the bent portion 653 of the flexible member 602 is closer to the outer circumferential surface of the magnetic roller 430 than the other part is. However, when the two-component developer 90 passes through the layer thickness limiting position L4, the two-component developer 90 entering between the front end surface 611 of the blade 601 and the surface of the magnetic roller 430 presses the first opposed portion 651 of the flexible member 602 to the front end surface 611 side of the blade 601 (see arrow A).

Thus, the first opposed portion 651 of the flexible member 602 moves away from the magnetic roller 430. Along with this, the bent portion 653 of the flexible member 602 also moves away from the magnetic roller 430. As a result, the layer thickness of the two-component developer 90 is limited substantially to the thickness corresponding to the gap between the circumferential surface of the developing roller 432 and the front end surface 611 of the blade 601.

By setting the gap W2 to be greater than the gap W1, it becomes easy for the first opposed portion 651 to be displaced to the front end surface 611 side when the two-component developer 90 presses the first opposed portion 651 of the flexible member 602 to the front end surface 611 side of the blade 601 (see arrow A).

In step S401, if it is determined that the image formation job has been finished (YES in step S401), the control portion 200 advances the process to step S402.

<Step S402>

After determining that the image formation job has been finished, the control portion 200 determines whether or not a start condition for starting the reverse rotation control of the magnetic roller 430 has been satisfied. The start condition may be that, for example, the count value of a counter (not shown) described later exceeds a numerical value indicating a predetermined number of sheets. The numerical value is, for example, 10000.

If it is determined that the start condition has not been satisfied (NO in step S402), the control portion 200 ends the process. On the other hand, if it is determined that the start condition has been satisfied (YES in step S402), the control portion 200 advances the process to step S403.

<Step S403>

In step S403, the control portion 200 resets the count value of the counter. The counter counts the number of the recording sheets 9 on which images have been formed. For example, the counter may be realized by the CPU executing a program for counting up the number of times the image formation process has been executed, in the control portion 200. After the processing in step S403, the control portion 200 advances the process to step S404.

<Step S404>

Figure 6A:
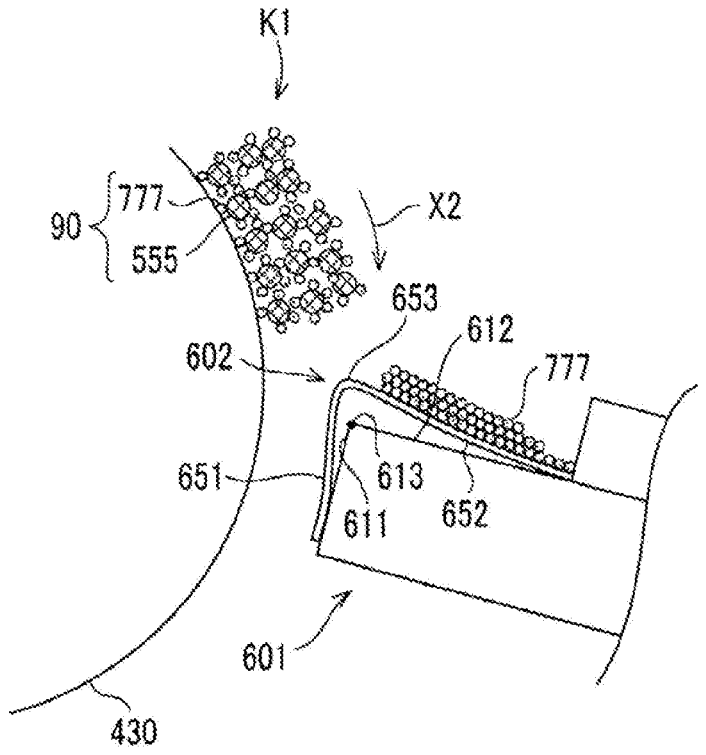
FIG. 6A and FIG. 6B are diagrams showing the state of the flexible member and the state of the two-component developer carried by the magnetic roller when the magnetic roller is reversely rotated.

In step S404, the control portion 200 starts the reverse rotation control for the magnetic roller 430. Under the reverse rotation control, the control portion 200 reversely rotates the magnetic roller 430. Thus, as shown in FIG. 6A, the magnetic brush K1 formed on the surface of the magnetic roller 430 moves toward the surface of the blade 601.

In the reverse rotation control, the magnetic roller 430 rotates in the reverse rotation direction X2, and a force to press the first opposed portion 651 of the flexible member 602 to the front end surface 611 side of the blade 601 (see arrow A) is not exerted. Therefore, as shown in FIG. 6A, the bent portion 653 of the flexible member 602 is in the original state, i.e., is closer to the outer circumferential surface of the magnetic roller 430 than the other part is.

Figure 6B:
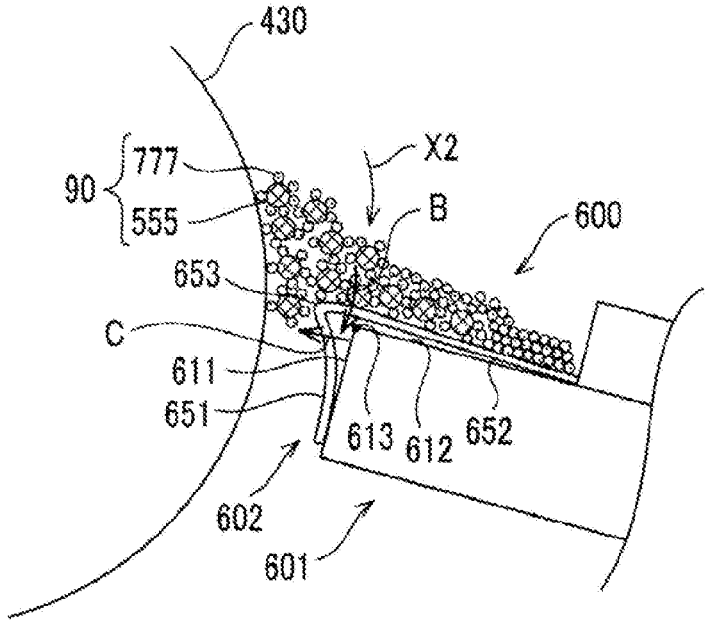

Therefore, as shown in FIG. 6B, the magnetic brush K1 carried on the surface of the magnetic roller 430 is caught on the bent portion 653 and the second opposed portion 652 of the flexible member 602. At this time, the bent portion 653 and the second opposed portion 652 are subjected to a force in a downward direction (see arrow B in FIG. 6B) and in a direction (see arrow C) to approach the magnetic roller 430 from the two-component developer 90 on the magnetic roller 430 rotating in the reverse rotation direction X2. Thus, the bent portion 653 is displaced to a position further close to the surface of the magnetic roller 430.

Here, by setting the second interval Y2 to be longer than the first interval Y1, it become easy for the bent portion 653 to approach the surface of the magnetic roller 430 when the bent portion 653 and the second opposed portion 652 are subjected to the force in the downward direction (see arrow B) and in the direction (see arrow C) to approach the magnetic roller 430 from the magnetic brush K1.

The two-component developer 90 forming a part, of the magnetic brush K1, that is caught on the bent portion 653 and the second opposed portion 652 runs onto an upper surface of the second opposed portion 652 of the flexible member 602 while dispersing, to collide with the toner accumulated on the upper surface.

Figure 7A:
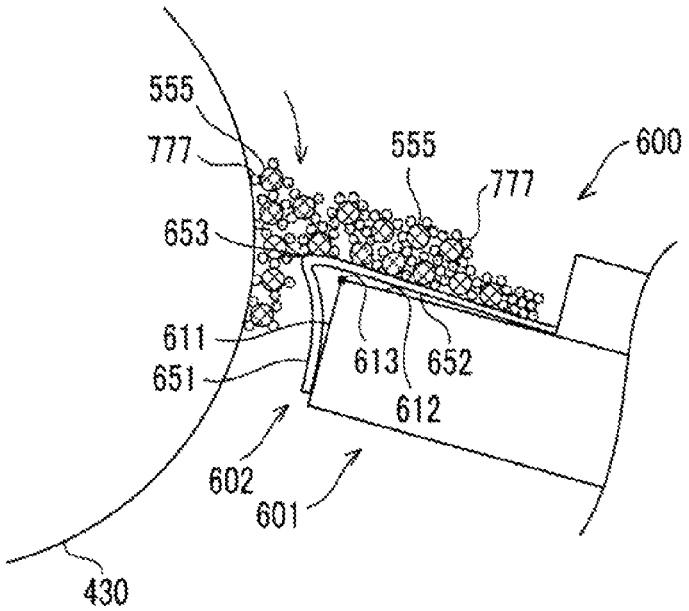
FIG. 7A and FIG. 7B are diagrams showing the state of the flexible member and the state of the two-component developer carried by the magnetic roller when the magnetic roller is reversely rotated.

The carrier 555 contained in the two-component developer 90 that has run onto the upper surface of the second opposed portion 652 has a polarity opposite to the polarity of the toner 777 accumulated on the upper surface of the flexible member 602. Therefore, as shown in FIG. 7A, by an electrostatic force, the toner 777 accumulated on the second opposed portion 652 is adhered to the carrier 555 on the upper surface of the second opposed portion 652 of the flexible member 602. Thus, as compared to the conventional configuration in which the flexible member 602 is not provided, the amount of the carrier 555 to which the toner 777 accumulated on the upper surface of the second opposed portion 652 of the flexible member 602 is adhered increases, and as compared to the conventional configuration, the toner removal performance can be improved.

Figure 7B:
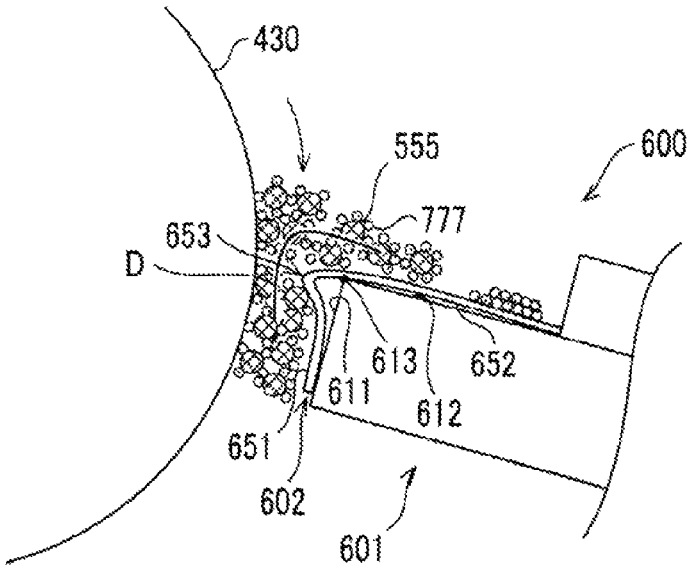

As shown in FIG. 7B, the carrier 555 to which the toner 777 has been adhered, i.e., the two-component developer 90 is attracted to the magnetic roller 430 by an electrostatic force. The two-component developer 90 is guided to the gap between the first opposed portion 651 and the magnetic roller 430 by the second opposed portion 652 of the flexible member 602, which is deformed such that the bent portion 653 is displaced in a downward direction and in a direction to approach the magnetic roller 430. Then, the two-component developer 90 drops to the developer tank 450 through the gap (see arrow D). Thus, the toner 777 accumulated on the upper surface of the second opposed portion 652 of the flexible member 602 is scraped by the magnetic brush K1.

After the processing in step S404, the control portion 200 advances the process to step S405.

<Step S405>

The control portion 200 determines whether or not a rotation time under the reverse rotation control for the magnetic roller 430 has reached a predetermined rotation time Tth1. The rotation time for the magnetic roller 430 is set to correspond to a desired rotation angle. The rotation time Tth1 may be a time taken for the magnetic roller 430 to rotate by an angle from the separation position L3 to the layer thickness limiting position L4 in the reverse rotation direction X2, for example.

If it is determined that the rotation time has not reached the rotation time Tth1 (NO in step S405), the control portion 200 executes the processing in step S405 again. On the other hand, if it is determined that the rotation time has reached the rotation time Tth1 (YES in step S405), the control portion 200 advances the process to step S406.

Here, the reverse rotation control is finished when the rotation time reaches the rotation time Tth1. However, a sensor for detecting that the reverse rotation angle reaches a desired angle may be provided, and the reverse rotation control may be finished as a result of the detection by the sensor.

The carrier 555 carried on the surface of the magnetic roller 430 is separated from the surface, at the separation position L3. Therefore, there is almost no carrier 555 on the surface of the magnetic roller 430 from the separation position L3 to the developer transfer position L1 in the development rotation direction X1. Therefore, even if the magnetic roller 430 is reversely rotated to exceed the rotation angle from the separation position L3 to the layer thickness limiting position L4, the performance for removing the accumulated toner hardly changes.

In order to avoid delay of start of execution of an image formation job that can be newly generated, it is desirable that the time needed for the reverse rotation control is as short as possible.

As described above, in the present embodiment, the second rotation control portion 202 reversely rotates the magnetic roller 430 by the angle from the separation position L3 to the layer thickness limiting position L4 in the reverse rotation direction X2. Thus, the toner accumulated on the surface of the blade 601 can be efficiently removed in a short time by the magnetic brush K1. However, the rotation angle by which the magnetic roller 430 is reversely rotated is not limited to the rotation angle from the separation position L3 to the layer thickness limiting position L4 in the reverse rotation direction X2.

Figure 8:
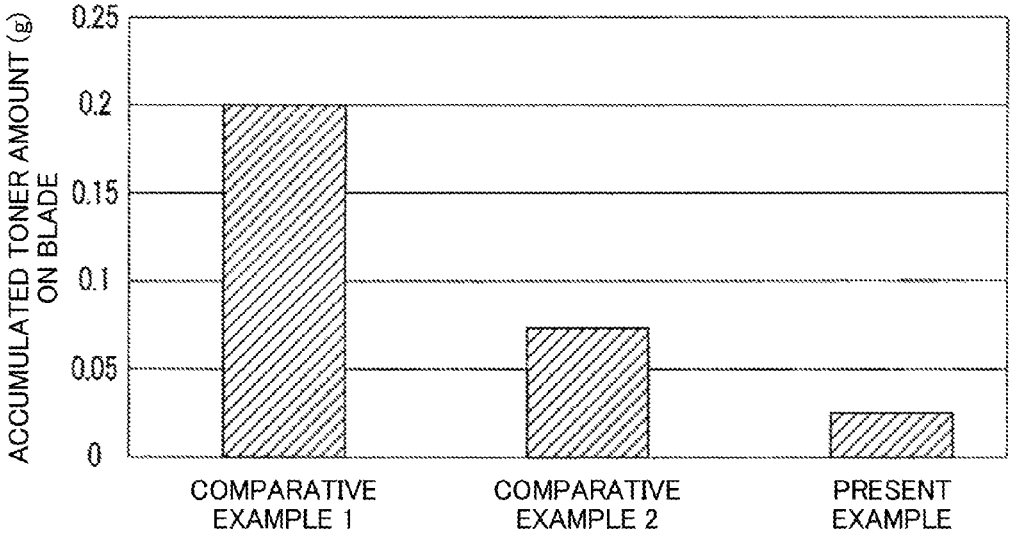
FIG. 8 is a diagram showing a result of verification of the effect of the first embodiment.

FIG. 8 shows a result of a test for verifying the effect of the present embodiment. FIG. 8 shows a result of a verification test in which the accumulation amount of the toner accumulated on the layer thickness limiting portion 600 is compared among the present embodiment (example) and two patterns of comparative examples 1 and 2.

In the verification test, images are formed on 10000 recording sheets 9 with an image printing rate set at 5%, and then the accumulation amount of the toner accumulated on the layer thickness limiting portion 600 is measured. The diameter of the magnetic roller 430 is 16 mm, the diameter of the developing roller is 16 mm, and the peripheral velocity conversion value of the rotation velocity of the developing roller is 208 mm/sec.

Comparative example 1 is the case where the reverse rotation control for the magnetic roller 430 is not performed. Comparative example 2 is the case where the magnetic roller 430 is reversely rotated when image formation is not performed, but the flexible member 602 is not provided. The rotation velocity (first rotation velocity V1) of the magnetic roller 430 when the development process is performed is 235 mm/sec in terms of peripheral velocity.

In the present example, the peripheral velocity conversion value of the second rotation velocity V2 under the reverse rotation control is 235 mm/sec. From the start of the reverse rotation control for the magnetic roller 430, rotational driving of the magnetic roller 430 is stopped at the time when the magnetic roller 430 is rotationally driven by one revolution. The thickness of the flexible member 602 is 50 μm. The bent portion 653 is formed at a position 1 mm above the boundary portion 613 between the front end surface 611 and the upper surface 612 of the blade 601.

As shown in FIG. 8, in comparison between comparative example 1 and comparative example 2, in comparative example 1, the accumulated toner amount is 0.2 g, and in comparative example 2, the accumulated toner amount is 0.07 g. Thus, the accumulated toner amount reduced to about ⅓.

In comparison between the present example and comparative example 2, an experimental result shows that, in the present example, the accumulated toner amount reduced to 0.020 g which is about ⅓ of the accumulated toner amount in comparative example 2.

Thus, in the present embodiment, as compared to the case where the flexible member 602 is not provided, the toner accumulated on the surface of the blade 601 can be further removed.

While preferred embodiments of the present disclosure have been described above, the present disclosure is not limited to the above content, but various modifications may be applied.

(Modification 1)

The developing device 43 according to the above embodiment is a device that develops an electrostatic latent image on the surface of the photosensitive drum 41 by a so-called interactive touchdown method. However, the developing device provided in the image forming apparatus 10 is not limited thereto.

That is, the developing device provided in the image forming apparatus 10 may be a developing device of a two-component development type. In the developing device of a two-component development type, the magnetic roller 430 functions also as the developing roller 432. That is, the magnetic roller 430 receives the two-component developer 90 contained in the developer tank 450, and brings the magnetic brush K1 into contact with the photosensitive drum 41. Thus, the magnetic roller 430 feeds the toner 777 to the photosensitive drum 41. In this case, the magnetic roller 430 corresponds to a developer carrying body that carries the agitated two-component developer 90, and the photosensitive drum 41 corresponds to a toner carrying body.

(Modification 2)

After the reverse rotation control by the second rotation control portion 202 has been finished, the first rotation control portion 201 may rotate the magnetic roller 430 in the development rotation direction X1 in advance in preparation for generation of an image formation job. Thus, when an image formation job is generated, the developer layer has been already formed on the surface of the magnetic roller 430. Therefore, the generated image formation job can be swiftly executed.

(Modification 3)

In the above embodiment, the bent portion 653 is curved. However, the bent portion 653 may be folded.

(Modification 4)

In the reverse rotation control, the second rotation control portion 202 may rotate the magnetic roller 430 at the second rotation velocity V2 faster than the first rotation velocity V1, and thereafter, may rotate the magnetic roller 430 at a third rotation velocity V3 slower than the second rotation velocity V2 in the reverse rotation direction X2. In this case, the toner accumulated on the surface of the blade 601 can be further efficiently removed.

By rotating the magnetic roller 430 at the second rotation velocity V2 faster than the first rotation velocity V1, the two-component developer 90 attracted to the magnetic roller 430 by a magnetic force of the magnet 440 slips on the surface of the magnetic roller 430. Owing to the slipping, the magnetic brush K1 congests to form a mass of the magnetic brush K1.

Thereafter, by rotating the magnetic roller 430 at the third rotation velocity V3 slower than the second rotation velocity V2, the time during which the mass of the magnetic brush K1 contacts with the toner accumulated on the layer thickness limiting portion 600 is prolonged, thus enabling removal of a larger amount of toner from the layer thickness limiting portion 600.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing device comprising:

a developer carrying body configured to, in a developer container, rotate in a first rotation direction while carrying a two-component developer on an outer circumferential surface of the developer carrying body, thereby conveying the two-component developer from a lower first position to an upper second position and feeding, at the second position, toner contained in the two-component developer to a toner carrying body at a next stage;

a layer thickness limiting portion provided, via a gap, being opposed to a part at a third position between the first position and the second position on the outer circumferential surface of the developer carrying body, the layer thickness limiting portion being configured to limit a layer thickness of the two-component developer carried by the developer carrying body rotating in the first rotation direction; and a rotation control portion configured to rotate the developer carrying body in the first rotation direction when a development process is performed, and rotate the developer carrying body in a second rotation direction opposite to the first rotation direction when the development process is not performed, wherein the layer thickness limiting portion includes:

a base body protruding toward a part at the third position on the outer circumferential surface of the developer carrying body; and a flexible member which is a sheet-like member having flexibility, the flexible member being attached to the base body such that the flexible member covers, via a gap, a range of the base body from a front end surface facing the developer carrying body to an upper surface, and a bent portion covering a boundary portion between the front end surface and the upper surface of the base body is closer to the outer circumferential surface of the developer carrying body than another part is, and a gap between a first part opposed to the upper surface of the base body via a space and the upper surface of the base body is greater than a gap between a second part opposed to the front end surface of the base body via a space and the front end surface of the base body.

2. The developing device according to claim 1, wherein the bent portion is folded.

3. The developing device according to claim 1, wherein the flexible member is mainly composed of polyethylene terephthalate.

4. The developing device according to claim 1, further comprising the toner carrying body configured to feed the toner to a photosensitive body that allows an electrostatic latent image to be formed on a surface thereof, thereby developing the electrostatic latent image.

5. The developing device according to claim 1, wherein the toner carrying body is a photosensitive body that allows an electrostatic latent image to be formed on a surface thereof, and the developer carrying body feeds the toner to the photosensitive body, at the first position, thereby developing the electrostatic latent image into a toner image.

6. A developing device comprising:

a developer carrying body configured to, in a developer container, rotate in a first rotation direction while carrying a two-component developer on an outer circumferential surface of the developer carrying body, thereby conveying the two-component developer from a lower first position to an upper second position and feeding, at the second position, toner contained in the two-component developer to a toner carrying body at a next stage;

a layer thickness limiting portion provided, via a gap, being opposed to a part at a third position between the first position and the second position on the outer circumferential surface of the developer carrying body, the layer thickness limiting portion being configured to limit a layer thickness of the two-component developer carried by the developer carrying body rotating in the first rotation direction; and a rotation control portion configured to rotate the developer carrying body in the first rotation direction when a development process is performed, and rotate the developer carrying body in a second rotation direction opposite to the first rotation direction when the development process is not performed, wherein the layer thickness limiting portion includes:

a base body protruding toward a part at the third position on the outer circumferential surface of the developer carrying body; and a flexible member which is a sheet-like member having flexibility, the flexible member being attached to the base body such that the flexible member covers, via a gap, a range of the base body from a front end surface facing the developer carrying body to an upper surface, and a bent portion covering a boundary portion between the front end surface and the upper surface of the base body is closer to the outer circumferential surface of the developer carrying body than another part is, and the flexible member is fixed to a first fixation portion distant by a first interval from the boundary portion on the front end surface of the base body, and fixed to a second fixation portion distant by a second interval longer than the first interval from the boundary portion on the upper surface of the base body.

7. The developing device according to claim 6, wherein the bent portion is folded.

8. The developing device according to claim 6, wherein the flexible member is mainly composed of polyethylene terephthalate.

9. The developing device according to claim 6, further comprising the toner carrying body configured to feed the toner to a photosensitive body that allows an electrostatic latent image to be formed on a surface thereof, thereby developing the electrostatic latent image.

10. The developing device according to claim 6, wherein the toner carrying body is a photosensitive body that allows an electrostatic latent image to be formed on a surface thereof, and the developer carrying body feeds the toner to the photosensitive body, at the first position, thereby developing the electrostatic latent image into a toner image.

11. An image forming apparatus comprising:

a photosensitive body that allows an electrostatic latent image to be formed on a surface thereof;

the developing device according to claim 6, configured to feed the toner to the photosensitive body, thereby developing the electrostatic latent image into a toner image; and a transfer portion configured to transfer the toner image formed on the photosensitive body, to a recording sheet.

12. An image forming apparatus comprising:

a photosensitive body that allows an electrostatic latent image to be formed on a surface thereof;

the developing device according to claim 1, configured to feed the toner to the photosensitive body, thereby developing the electrostatic latent image into a toner image; and a transfer portion configured to transfer the toner image formed on the photosensitive body, to a recording sheet.

* * * * *